US007882956B2

(12) United States Patent
McDonald et al.

(10) Patent No.: US 7,882,956 B2
(45) Date of Patent: Feb. 8, 2011

(54) SUSPENSION PACKAGING SYSTEM

(76) Inventors: John McDonald, 1088 Via Prado, Fallbrook, CA (US) 92028; Frank Comerford, 20 Hermitage La., Laguna Niguel, CA (US) 92677; Myles Comerford, 17147 Sobre Los Cerros, Rancho Santa Fe, CA (US) 92091

( * ) Notice: Subject to any disclaimer, the term of this patent is extended or adjusted under 35 U.S.C. 154(b) by 222 days.

(21) Appl. No.: 11/965,591

(22) Filed: Dec. 27, 2007

(65) Prior Publication Data

US 2008/0099368 A1 May 1, 2008

Related U.S. Application Data

(63) Continuation of application No. 10/990,095, filed on Nov. 15, 2004, now abandoned.

(51) Int. Cl.
*B65D 81/07* (2006.01)

(52) U.S. Cl. ..... 206/583; 206/591

(58) Field of Classification Search ..... 206/521, 206/583, 594, 591, 320, 497, 495; 229/120.06, 229/120.16

See application file for complete search history.

(56) References Cited

U.S. PATENT DOCUMENTS

| | | | | |
|---|---|---|---|---|
| 1,821,692 A | | 9/1931 | Copeland | |
| 2,161,128 A | | 6/1939 | Boyle | |
| 2,723,796 A | * | 11/1955 | Malmgren | 229/120.26 |
| 2,797,855 A | * | 7/1957 | Moore | 229/120.26 |
| 2,948,455 A | | 8/1960 | Frankenstein | |
| 2,956,672 A | | 10/1960 | Kirkpatrick | |
| 3,047,137 A | | 7/1962 | Kindseth | |
| 3,285,493 A | * | 11/1966 | Coe et al. | 229/120.16 |
| 3,326,410 A | | 6/1967 | Asenbauer | |
| 3,345,643 A | | 10/1967 | Bradley | |
| 3,853,220 A | | 12/1974 | Luray | |

(Continued)

FOREIGN PATENT DOCUMENTS

DE 299 21 203 U1 2/2000

(Continued)

OTHER PUBLICATIONS

International Search Report dated Jul. 22, 2008 from PCT/US2008/57132, filed on Mar. 14, 2008, Applicants: John McDonald et al.—3 pages.

(Continued)

*Primary Examiner*—David T Fidei
(74) *Attorney, Agent, or Firm*—Knobbe Martens Olson & Bear LLP

(57) ABSTRACT

A suspension packaging system can include a retention member having at least one pocket and a relatively more rigid member configured to be inserted into the pocket and folded into a state in which a tension in the retention member is increased. The more rigid member can be in the form of a tray and can include protrusions over which the pocket is placed. The protrusions can then be moved into engagement with apertures thereby engaging the resilient member between the protrusion and the aperture. Additionally, flaps of a box can be inserted into pockets of a resilient member and rotated so as to generate attention in the retention member so as to provide further cushioning of an article to be packaged therein.

17 Claims, 16 Drawing Sheets

U.S. PATENT DOCUMENTS

| | | | | |
|---|---|---|---|---|
| 3,905,474 | A | | 9/1975 | Haibara |
| 3,917,108 | A | | 11/1975 | Thurman |
| 4,077,518 | A | | 3/1978 | Kisslinger et al. |
| 4,155,453 | A | | 5/1979 | Ono |
| 4,606,460 | A | | 8/1986 | Luray |
| 4,801,774 | A | * | 1/1989 | Hart ..... 219/730 |
| 4,830,272 | A | * | 5/1989 | Wear et al. ..... 229/120.15 |
| 4,852,743 | A | | 8/1989 | Ridgeway |
| 4,923,065 | A | | 5/1990 | Ridgeway |
| 5,046,659 | A | | 9/1991 | Warburton |
| 5,056,665 | A | | 10/1991 | Boecker et al. |
| 5,071,009 | A | | 12/1991 | Ridgeway |
| 5,076,436 | A | | 12/1991 | Bortolani et al. |
| 5,080,497 | A | | 1/1992 | Peppiatt |
| 5,183,159 | A | | 2/1993 | Hojnacki et al. |
| 5,211,290 | A | | 5/1993 | Janus et al. |
| 5,218,510 | A | | 6/1993 | Bradford |
| 5,223,121 | A | | 6/1993 | Dickie et al. |
| 5,226,542 | A | | 7/1993 | Boecker et al. |
| 5,251,760 | A | | 10/1993 | Smith et al. |
| 5,322,168 | A | * | 6/1994 | Kataoka ..... 206/588 |
| 5,323,896 | A | | 6/1994 | Jones |
| 5,372,257 | A | | 12/1994 | Beauchamp et al. |
| 5,388,701 | A | | 2/1995 | Ridgeway |
| 5,394,985 | A | | 3/1995 | Van Hest |
| 5,405,000 | A | | 4/1995 | Hagedon et al. |
| 5,492,223 | A | | 2/1996 | Boardman et al. |
| 5,579,917 | A | | 12/1996 | Lofgren et al. |
| 5,641,068 | A | | 6/1997 | Warner |
| 5,669,506 | A | | 9/1997 | Lofgren et al. |
| 5,676,245 | A | | 10/1997 | Jones |
| 5,678,695 | A | | 10/1997 | Ridgeway |
| 5,694,744 | A | | 12/1997 | Jones |
| 5,722,541 | A | | 3/1998 | Lofgren et al. |
| 5,738,218 | A | | 4/1998 | Gonzales |
| 5,769,235 | A | | 6/1998 | Keach et al. |
| 5,788,081 | A | | 8/1998 | Bates et al. |
| 5,797,493 | A | | 8/1998 | Watson |
| 5,803,267 | A | | 9/1998 | Tu et al. |
| 5,823,348 | A | | 10/1998 | Phillips et al. |
| 5,823,352 | A | | 10/1998 | Mena et al. |
| 5,893,462 | A | | 4/1999 | Ridgeway |
| 5,894,932 | A | | 4/1999 | Harding et al. |
| 5,954,203 | A | | 9/1999 | Marconi |
| 5,967,327 | A | | 10/1999 | Jones |
| RE36,412 | E | | 11/1999 | Jones |
| 5,975,307 | A | | 11/1999 | Harding et al. |
| 5,988,387 | A | | 11/1999 | Staal et al. |
| 6,006,917 | A | | 12/1999 | Loeffler |
| 6,010,003 | A | | 1/2000 | Wilkinson |
| 6,073,761 | A | | 6/2000 | Jones |
| 6,079,563 | A | | 6/2000 | Katchmazenski |
| 6,119,863 | A | | 9/2000 | Lofgren et al. |
| 6,148,591 | A | | 11/2000 | Ridgeway et al. |
| 6,158,589 | A | | 12/2000 | Smith et al. |
| 6,206,194 | B1 | | 3/2001 | Beneroff et al. |
| 6,223,901 | B1 | | 5/2001 | Lofgren et al. |
| 6,289,655 | B1 | | 9/2001 | Ridgeway et al. |
| 6,302,274 | B1 | * | 10/2001 | Ridgeway ..... 206/583 |
| 6,311,843 | B1 | | 11/2001 | Smith et al. |
| 6,311,844 | B1 | | 11/2001 | Ridgeway et al. |
| 6,398,412 | B2 | | 6/2002 | Wedi et al. |
| 6,467,624 | B1 | | 10/2002 | Lofgren et al. |
| 6,675,973 | B1 | | 1/2004 | McDonald et al. |
| 6,899,229 | B2 | | 5/2005 | Dennison et al. |
| 6,920,981 | B2 | | 7/2005 | Lofgren et al. |
| 6,942,101 | B2 | | 9/2005 | Lofgren et al. |
| 7,000,774 | B2 | | 2/2006 | Bryant |
| 7,086,534 | B2 | | 8/2006 | Roesel et al. |
| 7,150,356 | B2 | | 12/2006 | Lofgren et al. |
| 7,290,662 | B2 | | 11/2007 | Lofgren et al. |
| 7,296,681 | B2 | | 11/2007 | McDonald et al. |
| 2001/0047950 | A1 | | 12/2001 | Beneroff et al. |
| 2003/0034273 | A1 | | 2/2003 | Auclair |
| 2003/0209463 | A1 | | 11/2003 | Halpin |
| 2003/0234207 | A1 | | 12/2003 | Koike |
| 2004/0108239 | A1 | | 6/2004 | McDonald et al. |
| 2004/0178113 | A1 | | 9/2004 | Lofgren et al. |
| 2005/0011807 | A1 | | 1/2005 | Dennison et al. |
| 2005/0121354 | A1 | | 6/2005 | Gillis et al. |
| 2006/0000743 | A1 | | 1/2006 | Lofgren et al. |
| 2006/0042995 | A1 | | 3/2006 | McGrath et al. |
| 2006/0102515 | A1 | | 5/2006 | McDonald et al. |
| 2006/0138018 | A1 | | 6/2006 | McDonald et al. |
| 2006/0213803 | A1 | | 9/2006 | Saitou et al. |
| 2007/0080095 | A1 | | 4/2007 | McDonald et al. |
| 2007/0251854 | A1 | | 11/2007 | McDonald et al. |
| 2008/0067103 | A1 | | 3/2008 | McDonald et al. |
| 2008/0128316 | A1 | | 6/2008 | McDonald et al. |
| 2008/0223750 | A1 | | 9/2008 | McDonald et al. |
| 2009/0272667 | A1 | | 11/2009 | McDonald et al. |

FOREIGN PATENT DOCUMENTS

| | | |
|---|---|---|
| DE | 101 05 487 A1 | 8/2002 |
| EP | 1 561 693 B1 | 5/2008 |
| SU | 827346 | 5/1981 |
| WO | 00/53499 A2 | 9/2000 |

OTHER PUBLICATIONS

Written Opinion of International Searching Authority dated Jul. 22, 2008 from PCT/US2008/57132, filed on Mar. 14, 2008, Applicants: John McDonald et al.—5 pages.

International Search Report dated Sep. 30, 2008 from PCT/US2007/010010, filed on Apr. 26, 2007, Applicants: John McDonald et al.—5 pages.

Written Opinion of International Searching Authority dated Sep. 30, 2008 from PCT/US2007/010010, filed on Apr. 26, 2007, Applicants: John McDonald et al.—8 pages.

European Office Action dated Feb. 9, 2009 for European Application No. 05013333.9, filed Jun. 21, 2005, Applicants: John McDonald et al.—7 pages.

European Office Action dated Feb. 9, 2009 for European Application No. 05013375.0, filed Jun. 22, 2005, Applicants: John McDonald et al.—5 pages.

European Search Report dated Feb. 13, 2006 for European Application No. 05013333.9, filed Jun. 21, 2005, Applicants: John McDonald et al. (4 pages).

European Search Report dated Feb. 10, 2006 for European Application No. 05013375.0, filed Jun. 21, 2005, Applicants: John McDonald et al., (2 pages).

International Search Report dated May 23, 2008 from PCT/US2007/086532, filed on Dec. 5, 2007, Applicants: John McDonald et al. (2 pages).

Written Opinion of International Searching Authority dated May 23, 2008 from PCT/US2007/086532, filed on Dec. 5, 2007, Applicants: John McDonald et al.

* cited by examiner

SUSPENSION PACKAGING SYSTEM

RELATED APPLICATION

This application is a Continuation of U.S. application Ser. No. 10/990,095, filed Nov. 15, 2004, which is hereby incorporated herein by reference.

BACKGROUND OF THE INVENTION

1. Field of the Invention

The present inventions are directed to a packaging system. In particular, the present inventions are directed to a suspension packaging system that includes a retention member having at least one pocket.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact to the box that can occur during loading, transit and unloading.

In most cases, some additional structure is used to keep the article from moving uncontrollably in the box and thus incurring damage. Such additional structures include paper or plastic packing material, structured plastic foams, foam-filled cushions, and the like. Ideally, the article to be packaged is suspended within the box so as to spaced from the walls defining the box, thus protecting the article from other foreign objects which may impact or compromise the outer walls of the box.

U.S. Pat. No. 6,675,973 discloses a number of inventions directed to suspension packaging assemblies which incorporate frame members and retention members. For example, many of the embodiments of the U.S. Pat. No. 6,675,973 include the use of a retention member formed of a resilient material. Additionally, some of the retention members include pockets at opposite ends.

In several of the embodiments disclosed in the U.S. Pat. No. 6,675,973, free ends of the frame members are inserted into the pockets of the retention member. The free ends of the frame member are then bent of folded to tension the retention member. Because the retention member is made from a resilient material, the retention member can stretch and thus provide a mechanism for suspending an article to be packaged, for example, within a box.

SUMMARY OF THE INVENTION

One aspect of the present invention includes the recognition that a retention sleeve having pockets can be used with frame members such that at least one of the pockets receives a protruding member of the frame member that is eventually interlocked with another portion of the frame member. As such, this type of retention member can be used in a variety of other types of devices thus improving the cushioning effect provided by these devices and/or providing additional devices.

For example, a retention sleeve having pockets formed therein at opposite ends thereof can be used in conjunction with a cardboard member folded to form a tray. This type of cardboard packaging member has been widely used in the packaging art. In this type of device, a relatively rigid material, such as, for example, but without limitation, corrugated cardboard, is cut into a generally rectangular shape and has foldable edges. Two or more of the edges can be shaped so as to have at least one protrusion at the distal edge thereof. When folded, the protrusion on the distal edge engages in an aperture formed at or near the proximal edge of the folding part. Thus, when folded, the protrusion locks into the aperture thereby forming a peripheral wall extending generally perpendicular to the central portion of the frame member.

With this type of device, the foldable portion can be inserted into a pocket of retention member having at least one pocket. The foldable portion can then be folded with the protruding part inserted into the aperture, thereby ensnaring the distal edge of the pocket between the protruding portion and the aperture. As such, the resilient nature of the retention member can be combined with the structural qualities of the frame member without the need for additional adhesives or connectors.

In accordance with another aspect of at least one of the inventions disclosed herein, a retention member having at least one pocket can be used in conjunction with flaps formed on a box. For example, when a box is assembled leaving one open end, usually there are four flaps remaining. Two of the flaps are folded first and then the remaining two flaps are folded over the first two flaps. The first two flaps to be folded closed can be inserted into pockets of a resilient retention member and thereby used to tension the retention member and provide additional suspension for the article package within the box.

In accordance with one embodiment, a packaging kit comprises at least one resilient retention member having a first end and a second end opposite the first end, and at least first and second pockets disposed at the first and second ends, respectively. At least one frame member includes a base portion and first and second foldable portions connected to and foldable relative to the base portion. The first foldable portion includes at least a first protrusion. The second foldable portion includes at least a second protrusion. The base portion includes at least first and second apertures configured to receive the first and second protrusions. The resilient retention member is sized such that the first foldable portion can be inserted into the first pocket and the second foldable portion can be inserted into the second pocket, and the first and second foldable portions can then be folded so as to engage the first and second protrusions with the first and second apertures, respectively, with the first and second pockets extending through the first and second apertures.

In accordance with another embodiment, a packaging kit comprises at least a first resilient retention member having at least a first pocket, and a base member having a base portion. A first aperture is disposed on the base portion. At least a first foldable portion is connected to and is rotatable relative to the base portion. The first foldable portion includes a protrusion sized to fit within the first aperture. The first foldable portion is sized to fit within the first pocket. The retention member is sized such that tension is generated in the retention member when the first foldable portion is inserted into the first pocket and the first protrusion is inserted into the first aperture.

In accordance with additional embodiment, a packaging kit comprises at least a first resilient retention member having at least a first pocket, and a base member having a base portion. A first aperture is disposed on the base portion. At least a first foldable portion is connected to and is rotatable relative to the base portion. The first foldable portion includes a protrusion sized to fit within the first aperture. Additionally, the kit includes means for ensnaring a portion of the first pocket between the aperture and the protrusion.

In accordance with another embodiment, a method is provided for packaging an article with a base member having a base portion and a foldable portion, the foldable portion having a protrusion configured to engage an aperture disposed on the base portion, and with a resilient retention member having at least one pocket. The method comprises inserting the foldable portion into the pocket, folding the foldable portion toward the base portion, engaging the protrusion with the aperture with a portion of the pocket being disposed between the protrusion and the pocket such that the portion of the pocket is pushed through the aperture by the protrusion, and supporting an article with the retention member.

For purposes of summarizing the inventions and the advantages achieved over the prior art, certain objects and advantages of the inventions have been described herein above. Of course, it is to be understood that not necessarily all such objects or advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other objects or advantages as may be taught or suggested herein.

All of these embodiments are intended to be within the scope of the inventions herein disclosed. These and other embodiments of the present inventions will become readily apparent to those skilled in the art from the following detailed description of the preferred embodiments having reference to the attached figures, the inventions not being limited to any particular preferred embodiment(s) disclosed.

BRIEF DESCRIPTION OF THE DRAWINGS

These and other features of the inventions will now be described with reference to the drawings of several embodiments of the present packaging assembly and kit which are intended to illustrate, but not to limit the inventions. The drawings contain the following figures.

DETAILED DESCRIPTION OF THE PREFERRED EMBODIMENT

An improved packaging system is disclosed herein. The packaging system includes an improved structure which provides new alternatives to known suspension packaging devices.

In the following detailed description, terms of orientation such as "upper," "lower," "longitudinal," "horizontal," "vertical," "lateral," "midpoint," and "end" are used here to simplify the description in the context of the illustrated embodiment. Because other orientations are possible, however, the present inventions should not be limited to the illustrated orientation. Those skilled in the art will appreciate that other orientations of the various components described above are possible.

Figure 1:
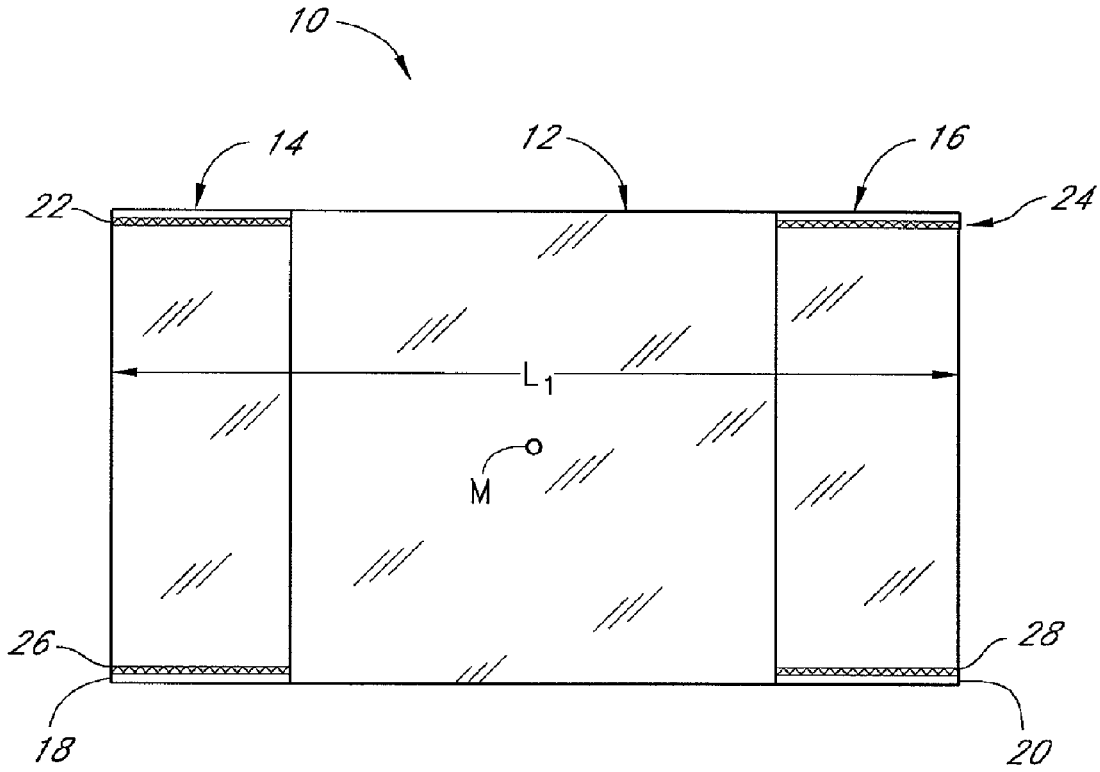
FIG. 1 is a top plan view of a retention member having pockets.

FIG. 1 illustrates a retention member 10. The retention member 10 is preferably formed of a resilient body 12. For purposes of convenience for the following description, the body 12 is identified as having a midpoint M positioned in the vicinity of the middle of the resilient body. The resilient body 12 also includes pockets 14, 16 at opposite ends thereof. In the illustrated embodiment, the retention member 10 is formed of a single piece of resilient material, and is sized to cooperate with another member having foldable portions, described in greater detail below.

In the illustrated embodiment, the pockets 14, 16 are formed of folds 18, formed in the resilient body 12 which have been attached (e.g., heat sealed) along lateral opposite edges thereof. In this embodiment, the heat sealing process forms the heat sealing lines 22, 24, 26, 28. The heat sealing lines 22, 24, 26, 28 can be continuous or formed of a plurality of heat-sealed points. One of ordinary skill in the art will appreciate that there are numerous methods for forming pockets in a resilient sheet material such as the resilient body 12. However, it has been found that heat sealing is particularly advantageous as it does not require expensive adhesives and the time consuming steps required for using it adhesives.

The retention member 10 has a length $L_1$ that is sized depending on the other devices with which the retention member 10 is to cooperate. Thus, the length $L_1$ can be sized such that when the retention member is in its final state, e.g., engaged with folding members of another device, it generates the desired tension for the corresponding application. Thus, the length $L_1$ will be smaller where a higher tension is desired and will be larger where a lower tension is desired. Additionally, the length $L_1$ might be different for different sized articles that are to be packaged. One of ordinary skill in the art can determine the length $L_1$ for the corresponding application.

The retention member 10 can be formed of any resilient material. In some embodiments, the retention member 10 can be made of applicable polyethylene film. However, virtually polymer, elastomer, or plastic film can be used to form the retention member 10. The density of the film can be varied to provide the desired retention characteristics such as overall strength, resiliency, and vibrational response. Preferably, the density of the retention member 10 is determined such that the retention member 10 is substantially resilient when used to package a particular article.

Figure 2:
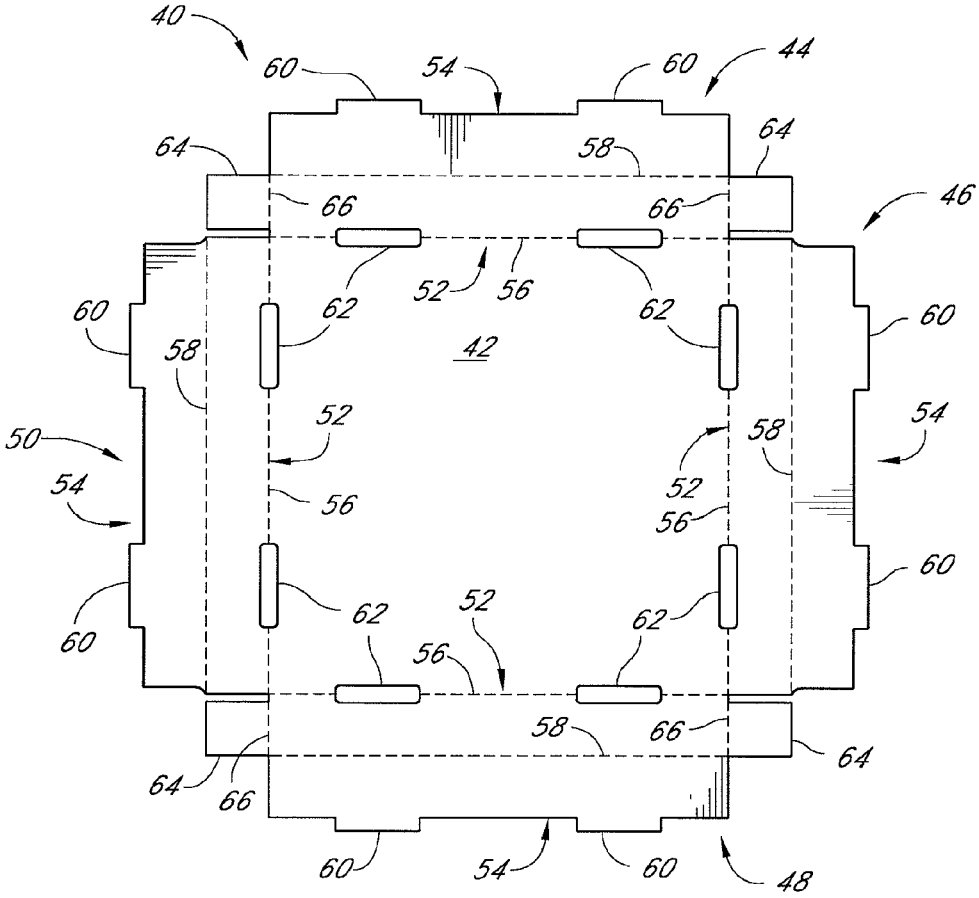
FIG. 2 is a bottom plan view of a tray member in an unfolded and unassembled state, the tray member having foldable portions disposed around a periphery of a central portion.

With reference to FIG. 2, a tray member 40 is configured to be folded into a shape generally corresponding to a tray. Generally, this type of device is long been known in the art.

The tray member 40 can be constructed from various materials, including but without limitation, paper, cardboard, corrugated cardboard, plastic, and/or other appropriate materials. The chosen material for constructing the tray member 40 can be any substantially rigid but foldable material. It will be appreciated that, although denominated as rigid, the chosen material would preferably have a certain amount of flexibility in the cases of extreme physical impact. In some embodiments, the material used to form the tray member 40 is a single wall corrugated C-flute cardboard.

FIG. 2 illustrates a bottom plan view of the tray member 40. The tray member 40 includes a central base member 42 and a plurality of foldable portions 44, 46, 48, 50. When assembled, the foldable portions 44, 46, 48, 50 are folded to define peripheral walls extending around the base member 42 and extending generally perpendicular to the base portion 42.

Each of the foldable portions 44, 46, 48, 50 include a proximal portion 52 that is disposed proximal to the base portion 42 and a distal portion 54 that is disposed distally from the base portion 42. The proximal portions 52 generally define a connection between the foldable portions 44, 46, 48, 50 and the base portion 42.

Each of the proximal portions 52 include a fold line 56. The fold lines 56 can be formed as perforations in the tray member 40, i.e., broken cut lines passing partially or completely through the material forming the tray member 40. In the alternative, or in addition, the fold lines 56 can be crushed portions of the material forming the tray member 40. Of course, depending on the material used to construct the tray member 40, the fold lines 56 can be formed as mechanical hinges, thinned portions or any other appropriate mechanical connection which would allow various portions of the tray member 40 to be folded or rotated with respect to each other.

In the illustrated embodiment, the foldable portions 44, 46, 48, 50 also include medial fold lines 58. The medial fold lines 58 allow each of the foldable portions 44, 46, 48, 50 to be folded. As such, in this embodiment, each of the foldable portions 44, 46, 48, 50 can be folded in half to define a double-walled portion around a periphery of the base member 42.

The distal portions 54 also include at least one protrusion 60. In the illustrated embodiment, each of the distal portions 54 include two protrusions 60. However, the number of protrusions 60 on the distal portions 54 can be varied.

The protrusions 60 on the distal portions 54 are configured to engage with apertures 62 disposed in the vicinity of the proximal portions 52. Thus, when the foldable portions 44, 46, 48, 50 are folded about the medial fold lines 58, the protrusion 60 can be inserted into the apertures 62, thereby securing the foldable portions 44, 46, 48, 50 into place. This technique is well known in the art.

With continued reference to FIG. 2, the illustrated tray member 40 also includes corner members 64 disposed on opposite ends of the foldable portions 46 and 48. Each of the corner members 64 are connected to the respective foldable portion 44, 48 by a corner fold line 66.

In order to assemble the tray member 40 into a tray-shaped device, the corner members 64 can first be folded upwardly, as viewed in FIG. 2, about the fold lines 66. Then, the foldable portions 44, 48 can be folded inwardly toward the base portion 44 about the fold lines 56. Once the foldable portions 44, 48 are folded into a state in which they extend generally perpendicular to the base portion 42, the corner member 64 will be generally aligned with the fold lines 56 of the foldable portions 46, 50.

Then the foldable portions 44, 48 can be folded about the medial fold lines 58 until the protrusions 60 engage with the apertures 62. The foldable portions 44, 48 can be sized such that as the foldable portions 44, 48 are folded about the medial fold line 58, the protrusions 60 snap into the apertures 62, thereby locking the foldable portions 44, 48 into that folded state.

With the corner member 64 aligned with the fold lines 56 of the foldable portions 46, 50, the foldable portions 46, 50 can be folded about their medial fold lines 58 in a similar manner. Thus, when the protrusions 60 of the foldable portions 46, 50 are engaged with the apertures 62, the corner members 64 are sandwiched within the respective foldable portions 46, 50, thereby locking the foldable portions 44, 46, 48, 50 together. This provides an enhanced structural rigidity of the tray member 40.

Figure 3:
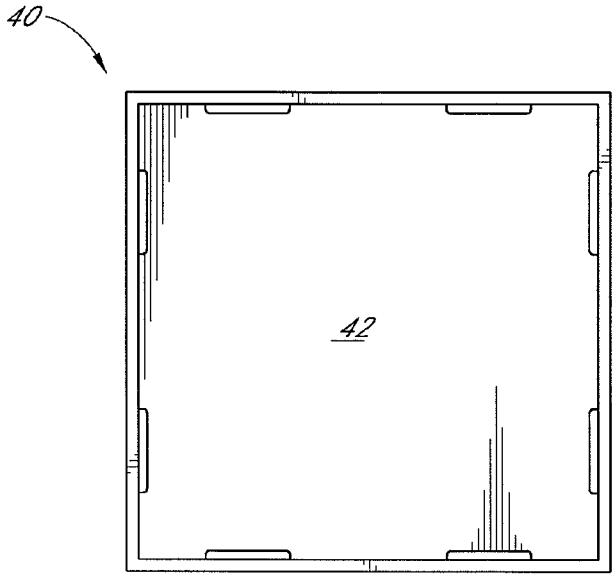
FIG. 3 is a bottom plan view the tray member of FIG. 2 in a folded state.

FIG. 3 is a bottom plan view of the tray member 40 in the folded state. When the tray member 40 is used in conjunction with the retention member 10, the pockets 14, 16 of the retention member 10 can be connected to the foldable portions 44, 48 or the foldable portions 46, 50.

Figure 4:
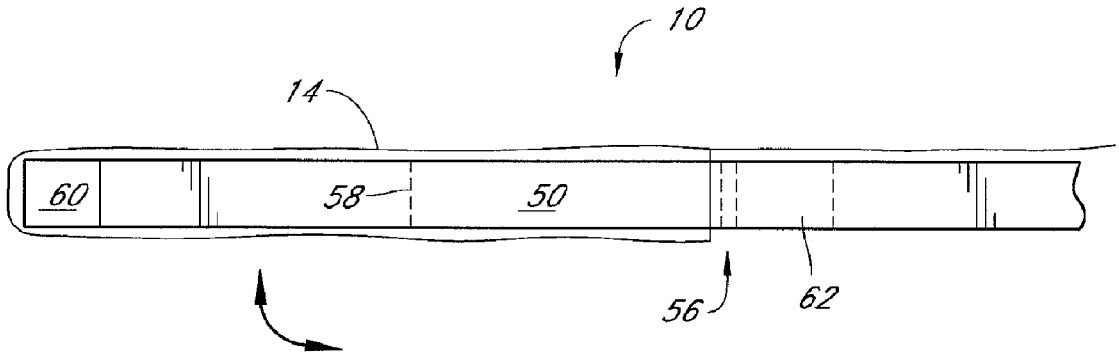
FIG. 4 is an enlarged elevational view of a folding portion of the tray member of FIG. 2 with a foldable portion inserted into one of the pockets of the retention member of FIG. 1.
Figure 5:
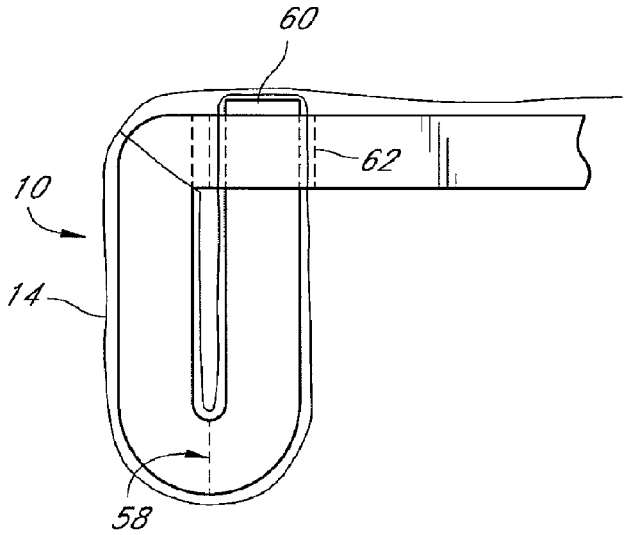
FIG. 5 is an elevational view of the folding portion of FIG. 4 in the folded state.

With reference to FIG. 4, foldable portion 50 is illustrated as being received with pocket 14 of the retention member 10. As such, the protrusion 60 is disposed within the pocket 14. Additionally, although not illustrated, in this method of assembling the tray member 40, the foldable portion 46 is received within the pocket 16 of the retention member 10.

In order to assemble the tray member 40, as noted above, the foldable portion 50 is folded about the fold line 56 and the fold line 58 until the protrusion 60 is engaged with the apertures 62. Additionally, the foldable portion 46 is also folded in a similar manner. When folded as such, the retention member 10 is stretched by the foldable portions 50, 46. The amount of tension generated by the folding of the foldable portions 46, 50 can be adjusted by adjusting the length $L_1$ of the retention member 10 (FIG. 1).

Figure 6:
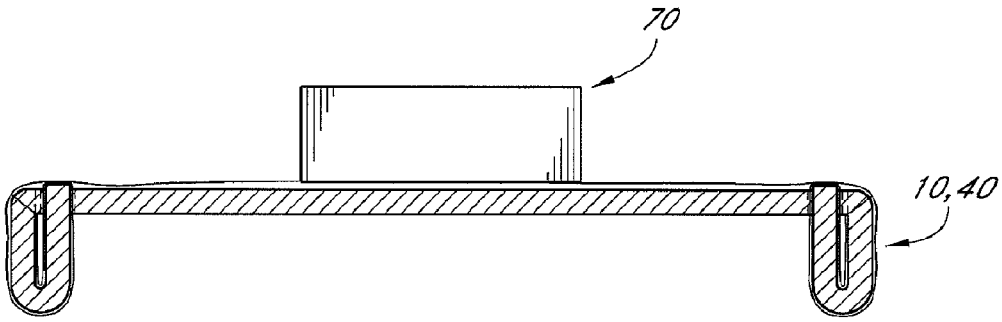
FIG. 6 is a partial sectional view of the tray member and retention member connected together and supporting an article to packaged thereon.

With reference to FIG. 6, the assembled retention member 10 and tray member 40 are illustrated therein as supporting an article to be packaged 70. As such, the retention member, tray member 40, and the article 70 can be packaged together within a box (not shown) such that the retention member 10 and tray member 40 can absorb shocks imparted into the article 70.

Figure 7:
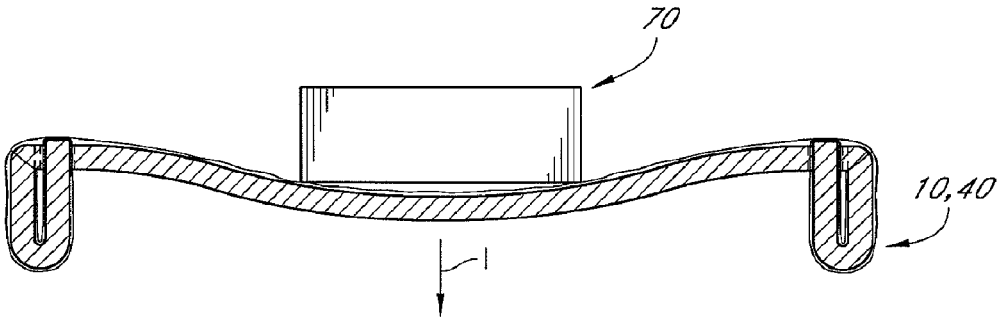
FIG. 7 is an elevational and partial sectional view of the arrangement in FIG. 6 showing a deflected state of the assembly and showing the flexation of the assembly when the article to be packaged is subjected to an acceleration.

For example, as shown in FIG. 7, the retention member 10 and tray member 40 can deflect together when a load I is applied to the article 70. As such, the retention member 10 and tray member 40 absorb the shock and thus prevent the article 70 from being damaged. In some embodiments, a portion of the base member 42 can be removed. In such an embodiment, either the retention member 10 or the base member 42 can primarily support the article 70. However, other modifications of the base member 42 can also be made.

Figure 8:
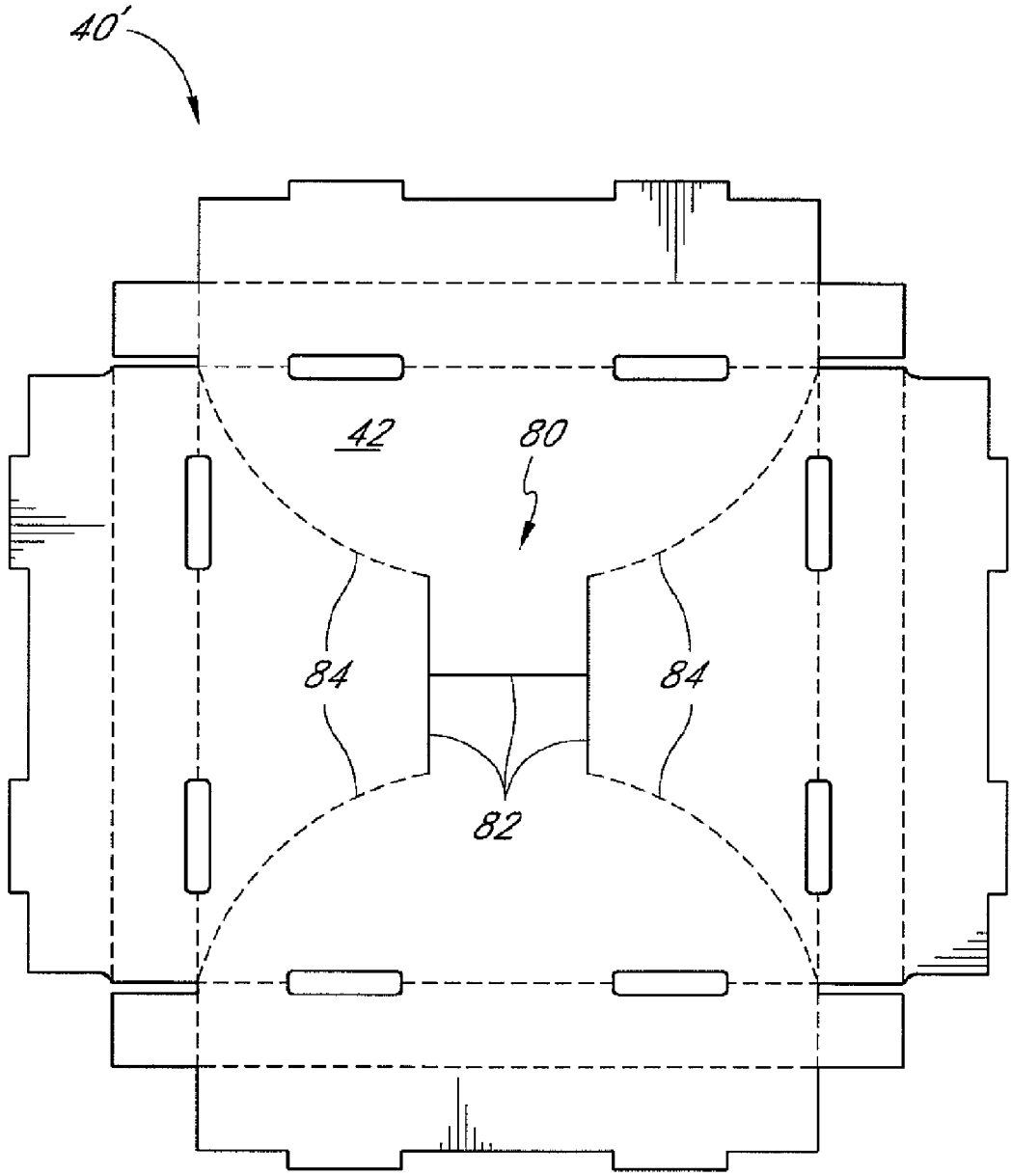
FIG. 8 is a bottom plan view of a modification of the tray member illustrated in FIG. 2, in an unassembled and unfolded state.
Figure 9:
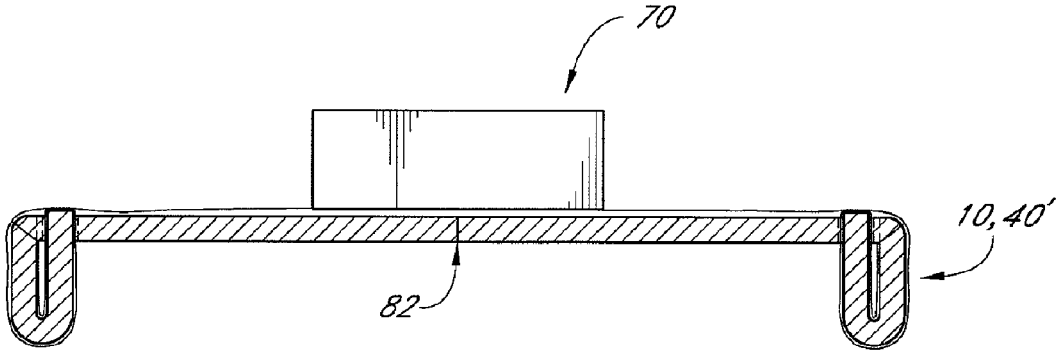
FIG. 9 is an elevational and partial sectional view of the tray member of FIG. 8, connected with a retention member and supporting an article to be packaged.
Figure 10:
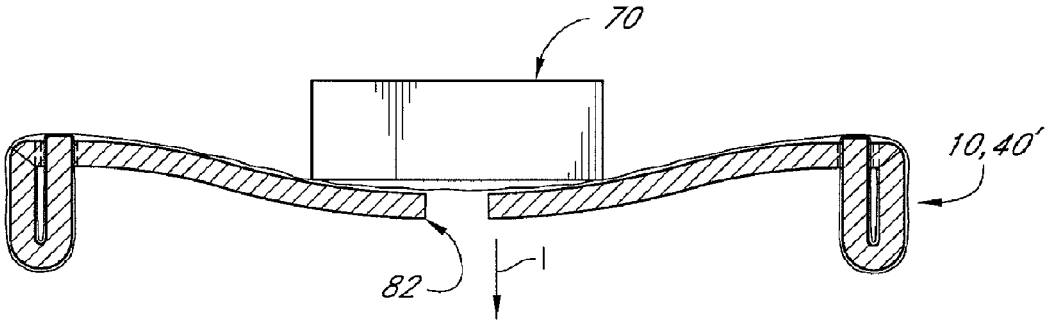
FIG. 10 is an elevational and partial sectional view of the arrangement shown in FIG. 9, with the tray member and retention member in a deflected state.

With reference to FIGS. 8-10, a modification of the tray member 40 is illustrated therein and identified generally by the reference numeral 40'. The tray member 40' illustrated in FIGS. 8-10 can be constructed substantially identically to the tray member 40 illustrated in FIGS. 2-7, except as noted as below. Thus, the tray member 40' shown in FIGS. 8-9 includes the same reference numerals as the tray member 40 shown in FIGS. 2-7, however, with a "'" added. The above description applies equally to the common elements unless otherwise indicated. Therefore, the description of those components will not be repeated.

With reference to FIG. 8, the tray member 40' can include one or a plurality of at least one of cut lines and fold lines therein. In the illustrated embodiment, the tray member 40' includes a plurality of cut lines 82 disposed in a central area of the base portion 42. The cut lines 82 can be formed by completely or nearly completely cutting through the material forming the base member 42.

Additionally, in the illustrated embodiment, the cut lines 82 are generally arranged in the shape of a "I". Additionally, the base member 42 includes a plurality of score lines 84. The score lines extend generally from the corners of the base member 42 toward the cut lines 82. The score lines 84 can be formed in the same manner as any of the above noted fold lines 52, 58, 66. Preferably, however, the score lines 84 include discontinuous cuts extending through the material forming the base member 42.

With reference to FIGS. 9 and 10, the cut lines 82 and score lines 84 can provide additional flexibility to the base member 42, thereby providing additional shock absorption. For example, with the retention member 10 attached to the tray member 40', the cut lines 82 can allow a portion of the base member 42 to separate (FIG. 10) and thereby further absorb energy from an impact or force I applied to the article 70. Additionally, the score lines 84 can further allow the base member 42 to separate or flex thereby further absorbing energy from the force I applied to the article 70.

Figure 11:
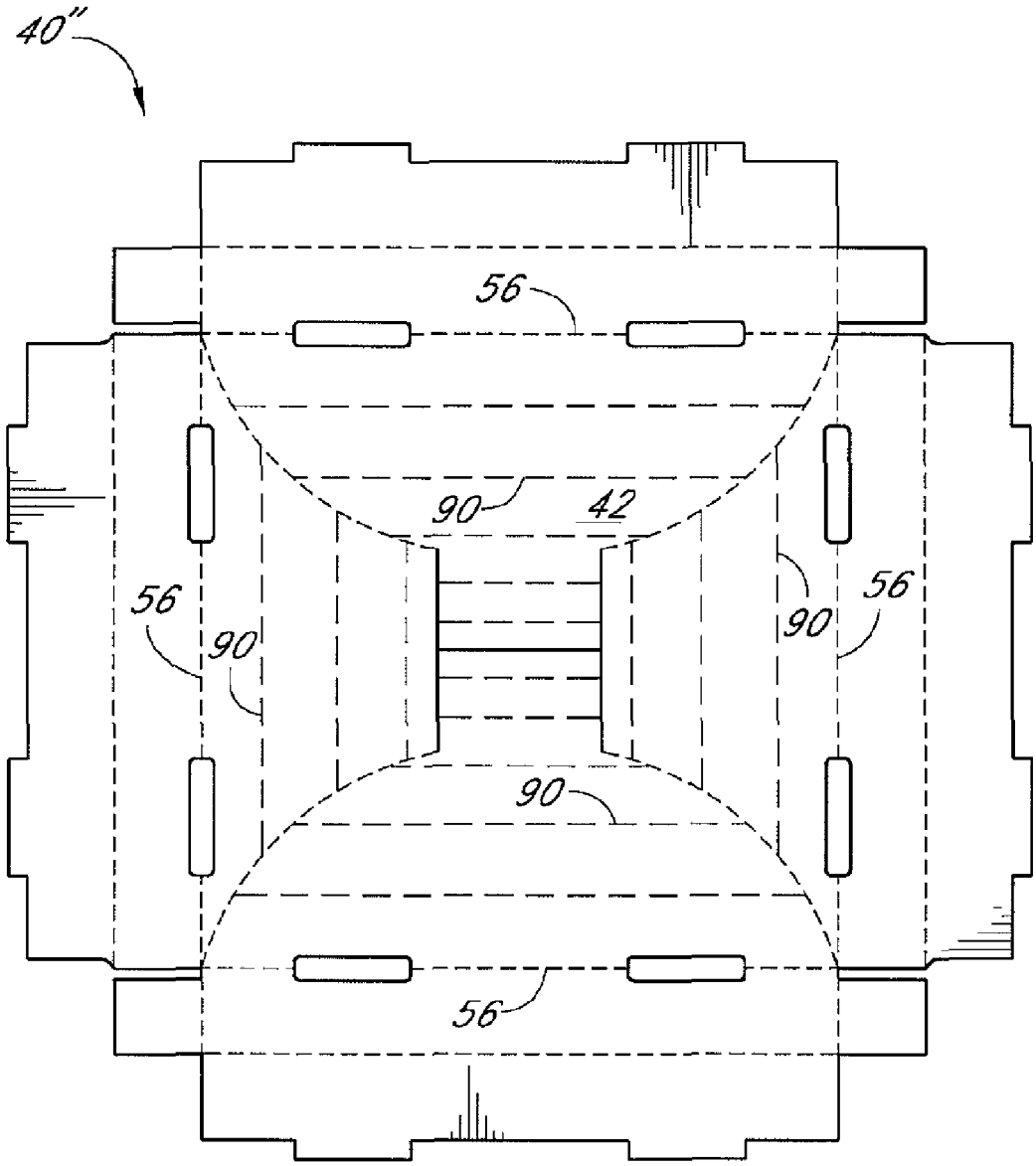
FIG. 11 is a bottom plan view of a further modification of the tray member of FIG. 2 illustrated in an unassembled and unfolded state.
Figure 12:
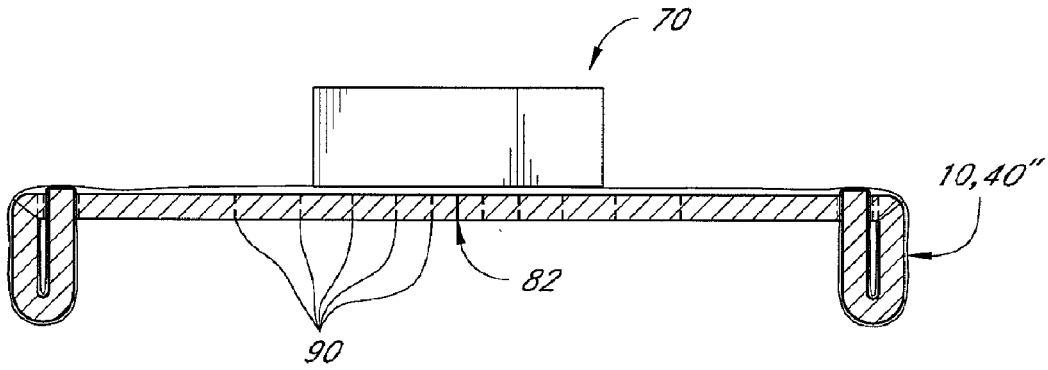
FIG. 12 is an elevational and partial sectional view of the tray member of FIG. 11 connected to a retention member and supporting an article to be packaged.
Figure 13:
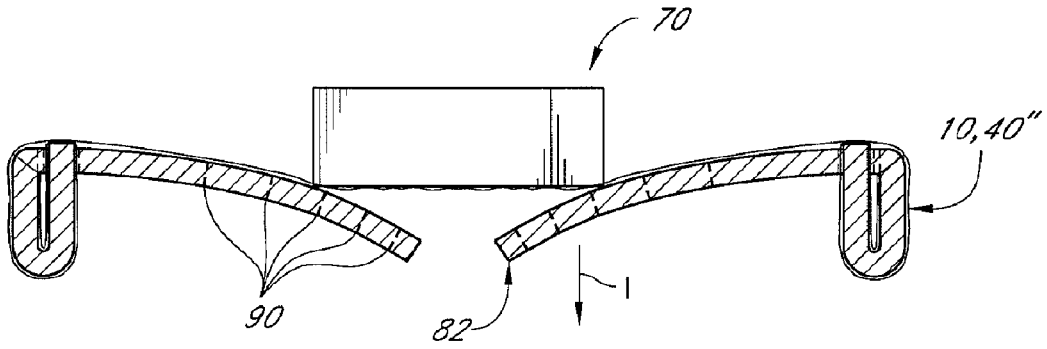
FIG. 13 is an elevational and partial sectional view of the arrangement shown in FIG. 12 and showing a deflected state of the arrangement.

With reference to FIGS. 11-13, a further modification the tray member 40 is illustrated therein and identified generally by the reference numeral 40". The tray member 40" shown in FIGS. 11-13 is constructed substantially identically to the tray members 40, 40', except as noted below. Thus, the tray member 40" shown in FIGS. 11-13 includes the same reference numerals as the tray members 40, 40', except that a "double prime" has been added. The above description applies equally to the common elements unless otherwise indicated. Therefore, a description of the common elements will not be repeated.

With reference to FIG. 11, the tray member 40" can also include additional score lines 90. In the illustrated embodiment, the additional score lines 90 extend generally parallel to the fold lines 56. Optionally, the score lines 90 can be arranged generally concentrically around the central area of the base member 42. The score lines 90 can be formed in any of the above-noted methods for forming fold lines or score lines, or other methods.

With reference to FIGS. 12 and 13, when a force I is applied to the article 70, the score lines 90 further aid in absorbing the energy created by the force I by allowing the base member 42 to further bend. Thus, the arrangement, size, and number of cut lines 82 and score lines 84, 90 can be adjusted to provide the desired energy absorption characteristic of the retention member 10 and tray member 40".

Figure 14:
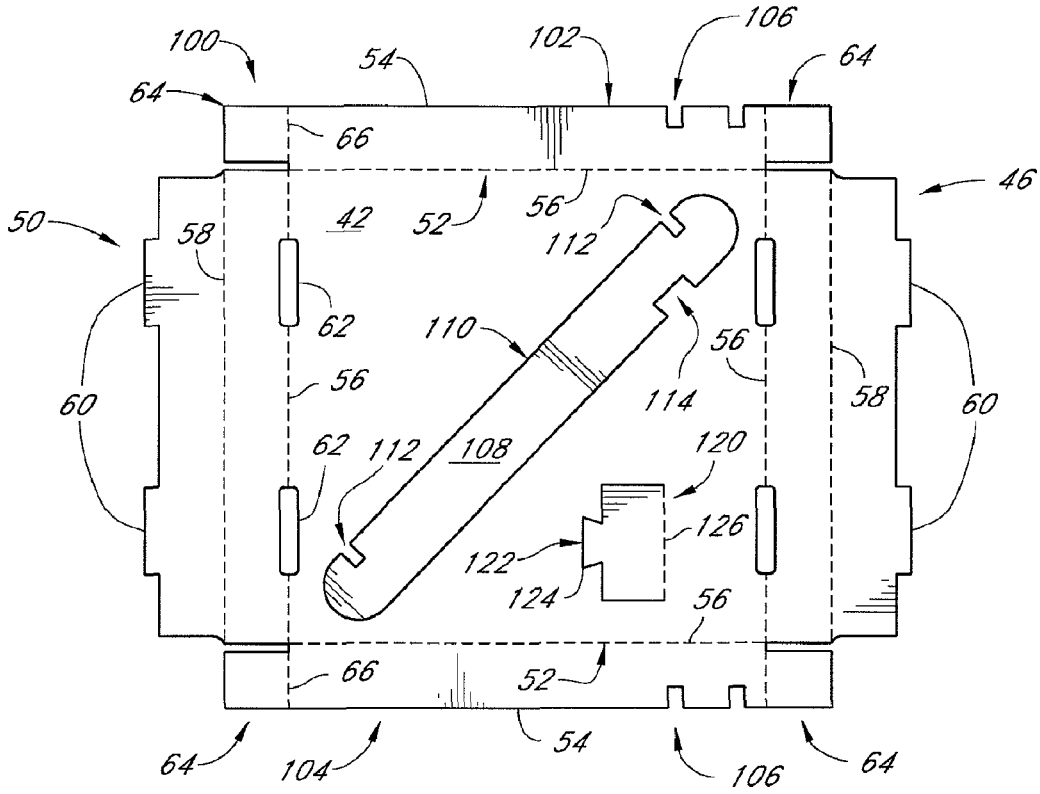
FIG. 14 is a bottom plan view of yet another modification of the tray member illustrated in FIG. 2 including a removable wall member and foldable locking member illustrated in an unassembled and unfolded state.

FIG. 14 illustrates yet another modification of the tray member 40 illustrated in FIG. 2 which is identified generally by the reference numeral 100. Certain components of the tray member 100 can be constructed identically or generally the same as corresponding components of the tray members 40, 40', 40". Those components are identified with the same reference numeral used with regard to the corresponding components of the tray members 40, 40', 40". Thus, a further description of those components will not be repeated. The above description applies equally to the common elements unless otherwise indicated.

The tray member 100 includes foldable portions 46, 50 arranged opposite each other. Additionally, the tray member 100 includes foldable portions 102, 104 that are also disposed opposite each other. The foldable portions 102, 104 do not include the medial fold line 58 that are included with the foldable portions 46, 50. Rather, the foldable portions 102, 104 are configured to form only a single wall when in the assembled state. Thus, the distal portions 54 of the foldable portions 102, 104 do not include the protrusions 60. Additionally, the proximal portions 52 of the foldable portions 102, 104 do not include apertures 62.

The foldable portions 102, 104 can include corner members 64 attached to the foldable portions 102, 104 at fold lines 66. The foldable portions 102, 104 also include retaining grooves 106 configured to cooperate with an optional wall member 108.

The optional wall member 108 can be formed by providing one or a plurality of cut or score lines 110 in the base member 42. In the illustrated embodiment, the cut or score lines 110 extend around a periphery of the wall member 108.

The cut or score lines 110 can also define one or a plurality of anchor grooves 112. The anchor grooves 112 are sized to as to be alignable with the alignment grooves 106.

The cut or score lines 110 can also define a locking notch 114. The locking notch 114 can be used in conjunction with other devices or portions of the tray member 100, described in greater detail below.

In some embodiments, the tray member 100 can also include a lock panel 120. The lock panel 120 can be configured to lock the wall member 108 relative to the base portion 42. In the illustrated embodiment, the lock panel 120 is defined by cut or score lines 122. The cut or score lines 122 can be arranged to define a locking tab 124 configured to engage the notch 114. Additionally, the lock panel 120 can include a fold line 126 configured to allow the panel 120 to be rotated relative to the base member 42.

Figure 15:
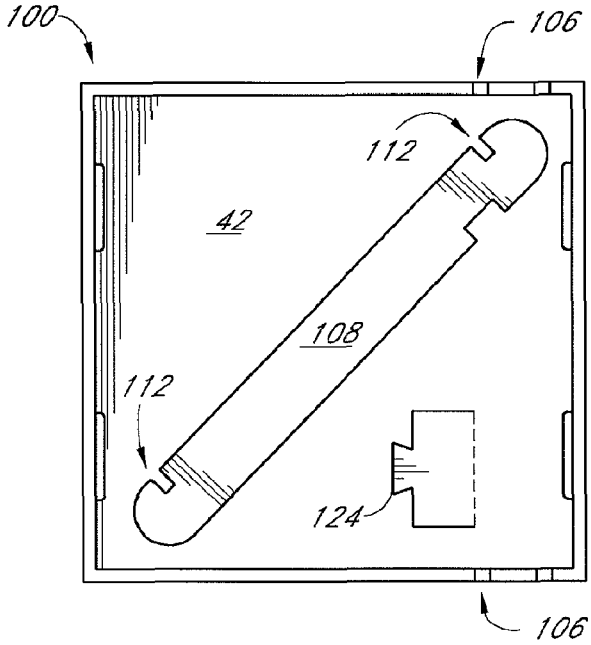
FIG. 15 is a bottom plan view of the tray member of FIG. 14 in a folded state.

FIG. 15 illustrates the tray member 100 in an assembled state in which the foldable portions 46, 50, 102, 104 are folded into place so as to define a wall extending peripherally around the base portion 42. Prior to or subsequent to assembling the tray member 100 as such, the wall portion 108 can be removed from the base portion 42. One of ordinary skill in the art can configure the cut or score lines 110 to allow the wall portion 108 to be removed or optionally left in place during use.

Figure 15A:
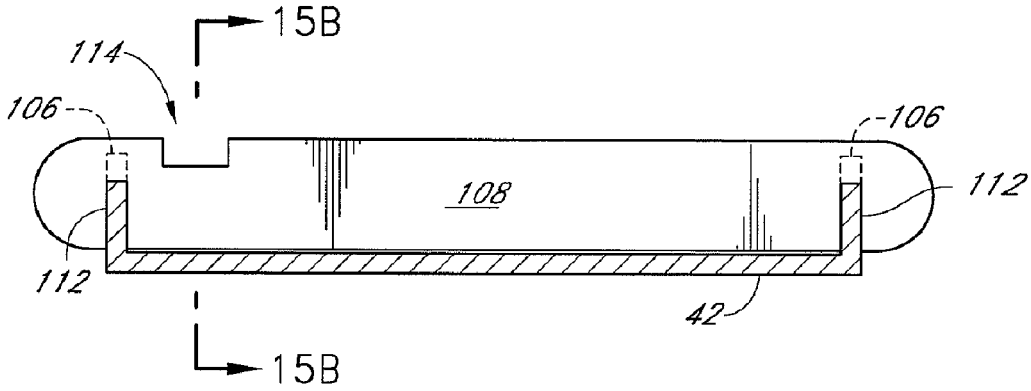
FIG. 15A is a sectional and partial elevational view of the tray of FIG. 15 with the wall member removed and inserted into slots in the side walls of the tray member.

With reference to FIG. 15A, the wall portion 108 can be removed from the base portion 42 and engaged with the foldable portions 102, 104. For example, the anchor grooves 112 can be aligned with the alignment notches 106. With the alignment grooves 106 and anchor grooves 112 nested with each other, as illustrated in FIG. 15A, the wall member 108 can be held in place so as to define a partition between areas on the bottom of the tray member 100.

Figure 15B:
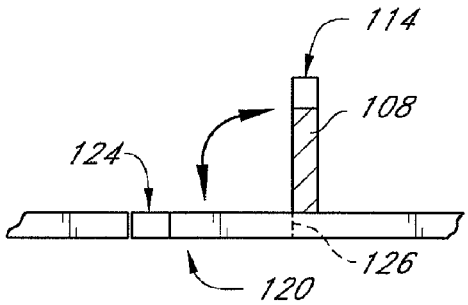
FIG. 15B is a sectional view taken along line 15B-15B of FIG. 15A.

For example, with reference to FIG. 15B, the wall member 108 divides the bottom of the tray member into areas 130 and 132. These divided areas 130, 132 can be used separate or keep separate items associated with an item to be packaged.

Figure 15C:
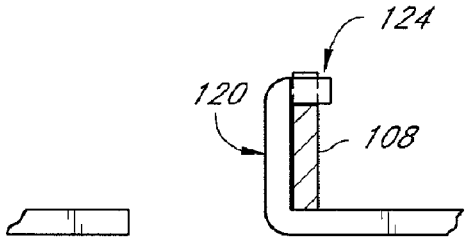
FIG. 15C is another sectional view showing the folded position of locking member locking the wall member of FIG. 15A in place.
Figure 15D:
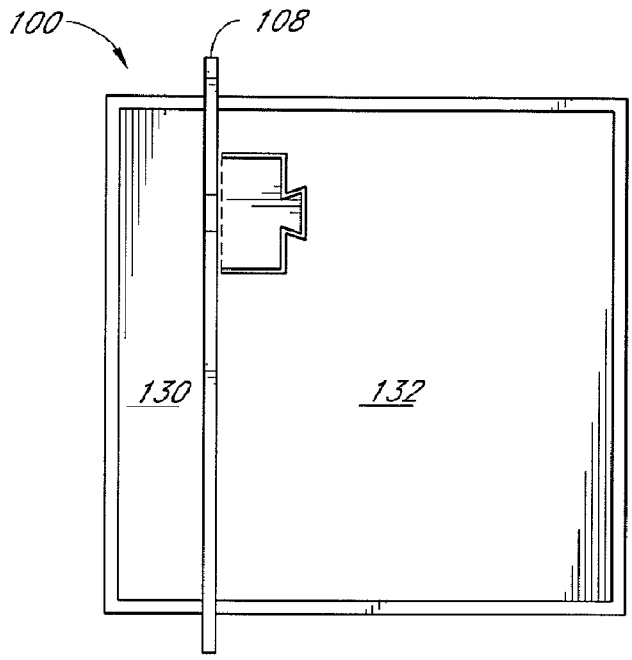
FIG. 15D is a bottom plan view of the arrangement of FIG. 15A.

Returning to FIG. 15A, with the wall member 108 engaged in the alignment grooves 106, the anchor notch 114 faces upwardly. With reference to FIG. 15B, the anchor panel 120 can be folded about the fold line 126 such that the panel 120 lies generally parallel to the wall 108, as illustrated in FIG. 15C. Additionally, the lock tab 124 can be further folded so as to engage with the lock groove 114.

As illustrated in FIGS. 14 and 15, the locking tab 124 can form an enlarged head portion. As such, when the locking tab 124 is fit into the lock groove 114, the enlarged head portion of the tab 124 aids in retaining the tab 124 in engagement with the groove 114.

Figure 15E:
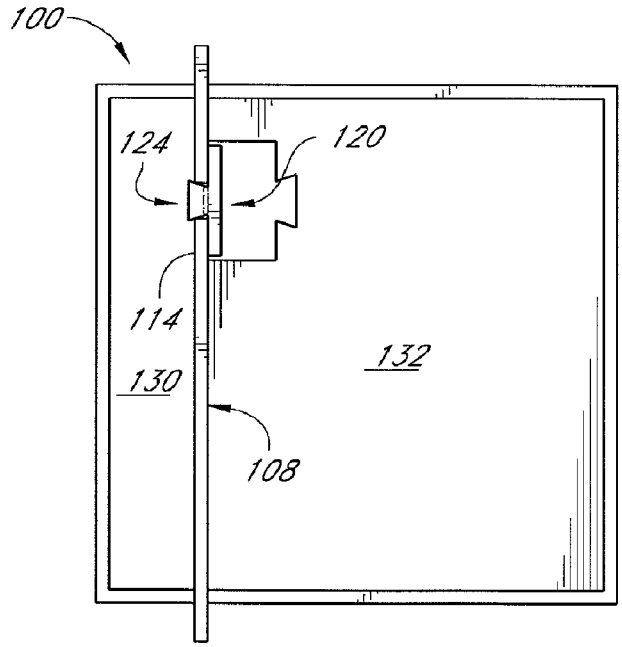
FIG. 15E a bottom plan view of the arrangement of FIG. 15C.

FIG. 15E illustrates a bottom plan view of the tray member 100 in the arrangement illustrated in FIG. 15C. As shown in FIG. 15E, the wall member 108 is locked in place by the locking panel 120 with the lock tab 124 engaged with the lock groove 114. As such, the lock panel 120 aids in helping keep the wall 108 from collapsing during use.

It is to be noted that with the wall member 108 removed from the base portion 42, the base portion 42 is provided with enhanced flexibility. Thus, when the tray member 100 is used to support an article, such as the article 70 illustrated in FIGS. 9 and 10, the base portion 42 can flex and thus absorb additional energy created by a force I acting on the article 70, similarly to the behavior of the tray member 40' illustrated in FIGS. 9 and 10.

Figure 16:
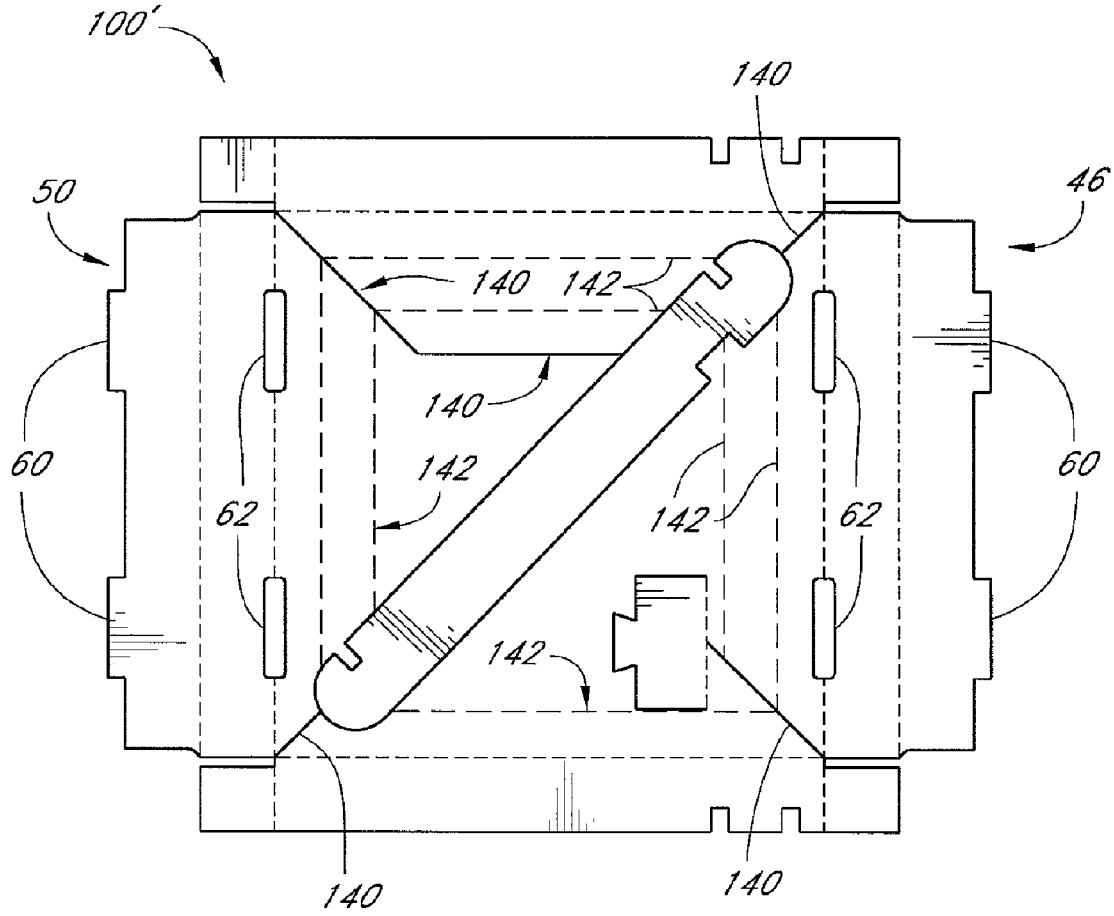
FIG. 16 is a bottom plan view of a modification of the tray member of FIG. 14 in an unassembled and unfolded state.

FIG. 16 illustrates a modification of the tray member 100, identified generally by the reference numeral 100'. Components of the tray member 100' that are the same or similar to corresponding components of the tray member 100 are identified with the same reference numerals. The above description applies equally to the common elements unless otherwise indicated. Therefore, a further description of those elements is not repeated below.

The tray member 100' can include a plurality of cut lines 140. Additionally, or in the alternative, the tray member 100' can include a plurality of score or fold lines 142. The inclusion of cut lines 140 and/or score or cut lines 142 allows the tray member 100' to behave in a manner described above with reference to the tray member 40" and with reference to FIGS. 12 and 13.

Additionally, with reference to the tray members 100, 100', the foldable portions 46, 50 can be inserted into the pockets of a resilient member, such as the resilient member 10 illustrated in FIG. 1. Thereafter, the foldable portions 46, 50 can be folded so as to engage the protrusions 60 with the apertures 62. Thus, the tray members 100, 100' can perform in accordance with the description set forth above with respect to the suspension assemblies comprising retention member 10 and one of the tray members 40, 40', 40".

Figure 17:
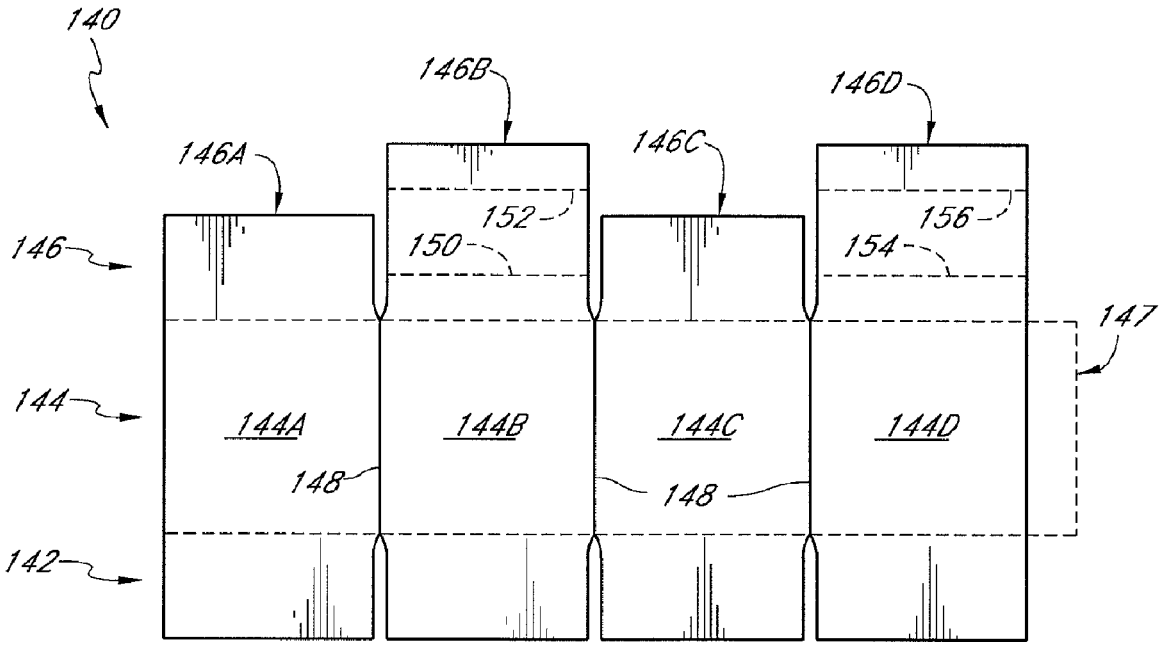
FIG. 17 is a plan view of a box member illustrated in an unassembled and unfolded state.

FIG. 17 illustrates a container member 140 in an unassembled and unfolded state. The container member 140 can be formed from a single or multiple pieces of generally rigid material. The rigid material can be the same or similar to the materials described above with reference to a tray member 40. Thus, as noted above, in some embodiments, the container member 140 can be formed from a corrugated cardboard material. However, other materials can also be used.

The container member 140 includes a plurality of bottom flaps 142, a plurality of wall panels 144, and a plurality of top flaps 146. Additionally, the container member 140 can include a wall connector member 147.

The wall panels 144 are identified as wall panel 144A, 144B, 144C, 144D. The wall panels 144A, 144B, 144C, 144D, can be connected along fold lines 148. The construction of the bottom flaps 142, wall panels 144, and connector 146 can be in accordance with the long and well known technique for forming a cardboard box out of a single piece of cardboard.

Figure 18:
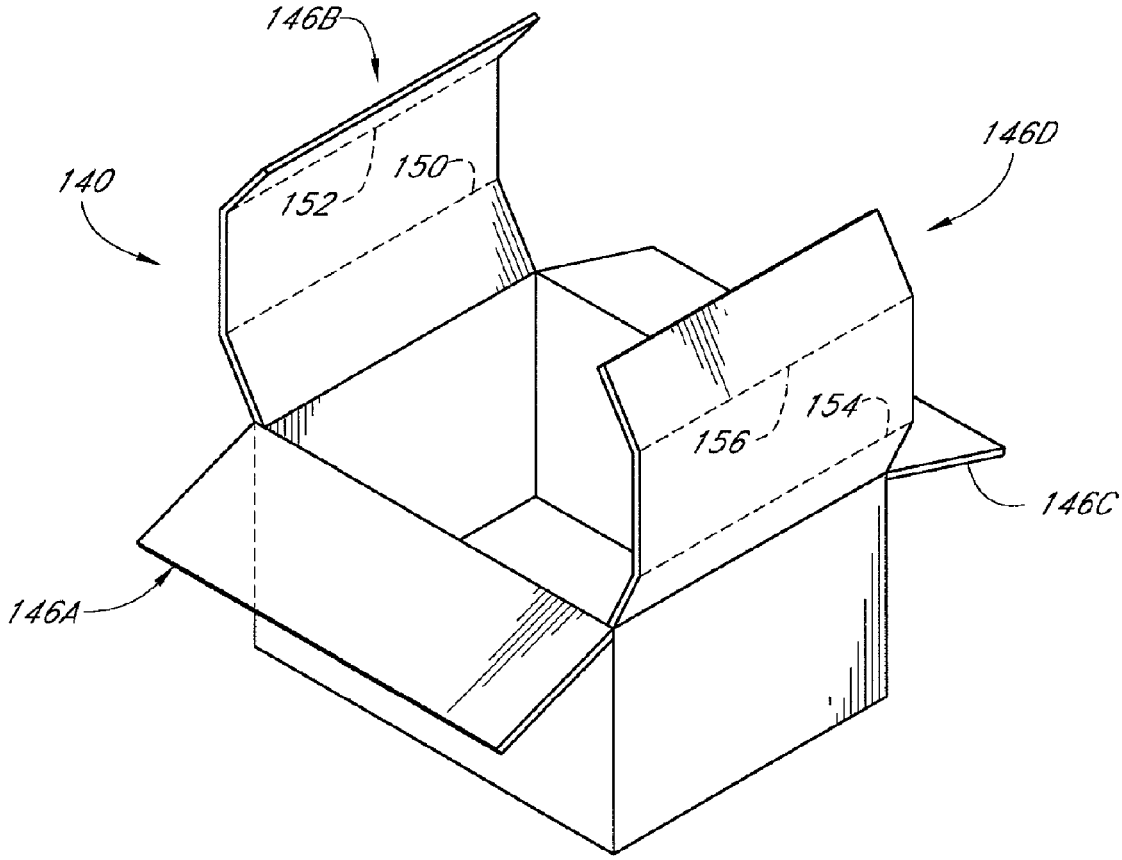
FIG. 18 is a top, front, and left-side perspective view of the box member of FIG. 17 in an assembled state with the top portion open.

For example, the plurality of wall panels 144 can be folded along the fold lines 146 and the connector 147 can be attached to the wall panel 144A, so as to form a box. Additionally, the bottom flaps 142 can be folded and secured in a known manner to form a bottom of a box. Assembled as such, the container member 140 takes the shape illustrated in FIG. 18.

With reference again to FIG. 17, a further advantage is provided where at least two of the top flaps 146 are provided with at least one fold line. In the illustrated embodiment, the plurality of top flaps 146 are identified as 146A, 146B, 146C, 146D. The top flaps 146B, 146D, which are disposed opposite to each other when the container member 140 is folded in the state illustrated in FIG. 18A, include proximal and distal fold lines. In the illustrated embodiment, the top flap 146B includes a proximal fold line 150 and a distal fold line 152. The top flap 146D includes a proximal fold line 154 and a distal fold line 156.

Figure 19:
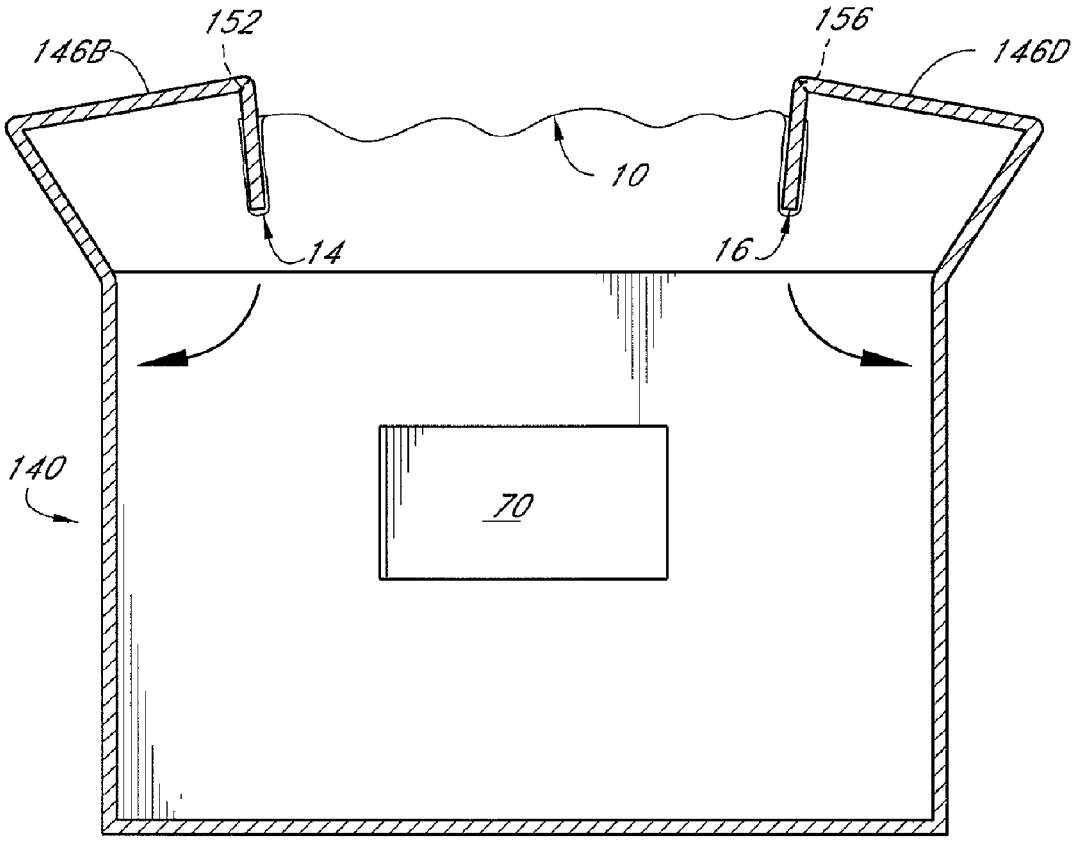
FIG. 19 is a sectional view of the box of FIG. 18 in a partially closed state with a retention member being engaged with two of the top flaps of the box.

By including at least one fold line in at least one of the plurality of top flaps 146, the container member 140 can be used in conjunction with a retainer member such as the retainer member 10 illustrated in FIG. 1. For example, with reference to FIG. 19, by folding the top flaps 146B, 146D about the fold lines 152, 156, respectively, the distal ends of the flaps 146B, 146D can be inserted into the pockets 14, 16 of the retention member 10. This arrangement is shown in FIG. 19. In use, an article to be packaged 70 can be disposed within the container member 140 prior to the connection of the retention member 10 to the top flaps 146. Thus, with the article 70 in place, the top flaps 146B, 146D can be further rotated inwardly, into the interior of the box member 140, thereby tightening the retention member 10. The article to be packaged 70 can be supported above the bottom of the box member 140 with any desired device.

However, a further advantage can be achieved where one of the tray members 40, 40', 40", 100, 100' and a retention member, such as the retention member 10 are used to support the article 70 in a position spaced from the bottom of the container member 140.

Figure 20:
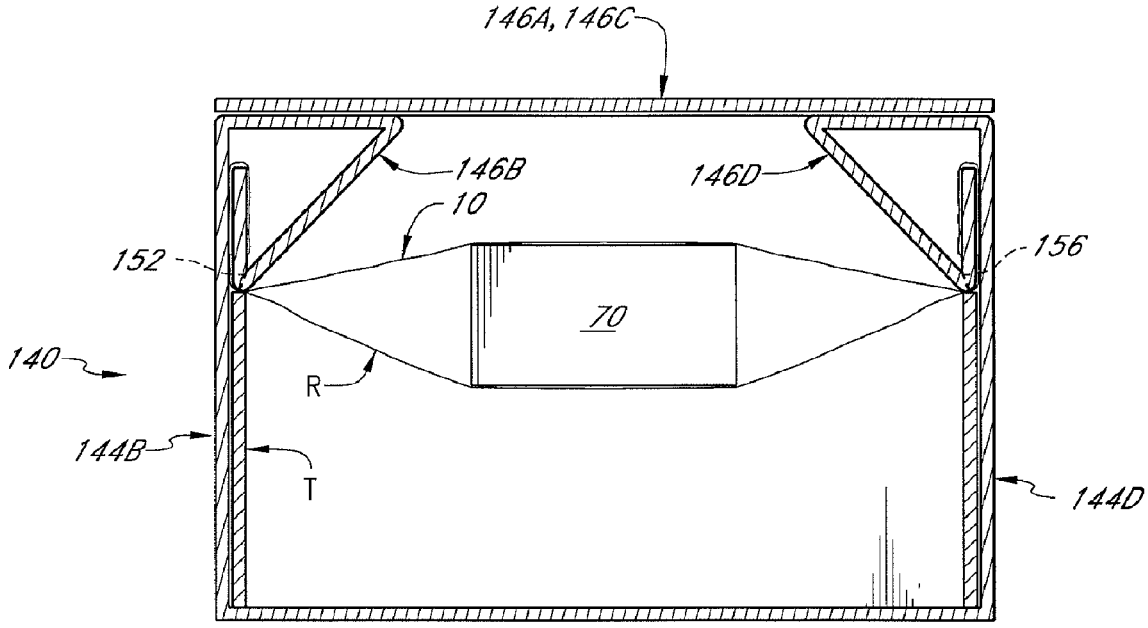
FIG. 20 is a sectional view of the box of FIG. 18 closed and supporting an article within the box.

FIG. 20 illustrates a tray member identified generally by the T engaged with a retention member identified generally by the reference numeral R supporting the article 70 above a bottom of the container member 140. The tray member T can be any one of the tray members 40, 40', 40", 100, 100' described above. The retention member R can be any resilient member, including, for example, but without limitation, the retention member 10 illustrated in FIG. 1.

In this arrangement, the retention member 10 is engaged with the top flaps 146B, 146D and the top flaps 146B, 146D are folded inwardly so as to tighten the retention member 10 across the top of the article 70. Additionally, the corners of the top flaps 146B, 146D created by the folding of the top flaps about the fold lines 152, 156 can be tucked between the upper periphery of the tray member T and the wall panels 144B, 144D, respectively. As such, the top flaps 146B, 146D are held in place and thus, generate tension in the retention member 10.

Additionally, the remaining top flaps 146A, 146C can be folded over the top flaps 146B, 146D to thereby further retain the top flaps 146B, 146D in the position shown in FIG. 20. In this arrangement, the retention members 10, R can be used to completely suspend the article 70 in an interior of the box member 140 in a position spaced from all of the walls and the top and bottom of the box member 140. Additionally, where the tray member T includes a base portion 42, the additional material of the base member 42 can be used to further cushion or absorb energy generated by forces acting on the article 70, in accordance with the description set forth above with respect to FIGS. 6, 7, 9, 10, 12, and 13.

Of course, the foregoing description is that of certain features, aspects and advantages of the present invention to which various changes and modifications can be made without departing from the spirit and scope of the present invention. Moreover, the packaging system may not feature all objects and advantages discussed above to use certain features, aspects, and advantages of the present inventions. Thus, for example, those skilled in the art will recognize that the inventions can be embodied or carried out in a manner that achieves or optimizes one advantage or group of advantages as taught herein without necessarily achieving other objects or advantages as may be taught or suggested herein. In addition, while a number of variations of the inventions have been shown and described in detail, other modifications and methods of use, which are within the scope of these inventions, will be readily apparent to those of skill in the art based upon this disclosure. It is contemplated that various combinations or subcombinations of the specific features and aspects of the embodiments may be made and still fall within the scope of the inventions. Accordingly, it should be understood that various features and aspects of the disclosed embodiments can be combined with or substituted for one another in order to form varying modes of the disclosed packaging assemblies. Thus, at least some of the present inventions, should only be defined by the appended claims.

What is claimed is:

1. A packaging kit for packaging an article, the packaging kit comprising:

at least one resilient retention member having a first end and a second end opposite the first end, and at least first and second pockets disposed at the first and second ends, respectively; and at least one frame member having a base portion configured to support an article and first and second foldable portions connected to and foldable relative to the base portion, the first foldable portion including at least a first protrusion, the second foldable portion including at least a second protrusion, and the base portion including at least first and second apertures configured to receive the first and second protrusions, wherein the base portion comprises at least one cut line located in a central portion of the base portion and a plurality of score lines, each of which extends from one of corners of the base portion toward the at least one cut line to provide flexibility to the base portion;

wherein the resilient retention member is sized such that the first foldable portion can be inserted into the first pocket and the second foldable portion can be inserted into the second pocket, and the first and second foldable portions can then be folded so as to engage the first and second protrusions with the first and second apertures, respectively, with the first and second pockets extending through the first and second apertures.

2. A packaging kit for packaging an article, the packaging kit comprising at least a first resilient retention member having at least a first pocket, and a base member having a base portion configured to support an article, a first aperture disposed on the base portion, and at least a first foldable portion connected to and rotatable relative to the base portion, the base portion comprising at least one cut line located in a central portion of the base portion and a plurality of score lines, each of which extends from one of corners of the base portion toward the at least one cut line to provide flexibility to the base portion, the first foldable portion including a protrusion sized to fit within the first aperture, the first foldable portion being sized to fit within the first pocket, wherein the retention member is sized such that tension is generated in the retention member when the first foldable portion is inserted into the first pocket and the first protrusion is inserted into the first aperture.

3. The kit according to claim 2, wherein the retention member includes a second pocket and the base member includes a second foldable portion configured to fit inside the second pocket.

4. The kit according to claim 2, wherein the first pocket is formed by heat sealing.

5. The kit according to claim 2, wherein the base member is formed from corrugated cardboard.

6. The kit according to claim 2, wherein foldable portions are disposed along a periphery of the base portion.

7. The kit according to claim 2 additionally comprising at least one cut line disposed in the base portion defining a removable wall member.

8. The kit according to claim 7, wherein the removable wall member includes a locking notch, and the base portion includes a locking panel configured to engage the locking notch.

9. The kit according to claim 2 additionally comprising a box member configured to form a box, the box member including at least first and second flaps configured to be folded inwardly into the interior of the box, and a second retention member having at least first and second pockets, the first and second flaps being sized to fit within the first and second pockets of the second retention member.

10. The kit according to claim 9, wherein the first and second flaps are sized to be inserted between outer walls of the box and the base member.

11. A packaging kit for packaging an article, the packaging kit comprising at least a first resilient retention member having at least a first pocket, and a base member having a base portion configured to support an article, a first aperture disposed on the base portion, and at least a first foldable portion connected to and rotatable relative to the base portion, the base portion comprising at least one cut line located in a central portion of the base portion and a plurality of score lines, each of which extends from one of corners of the base portion toward the at least one cut line to provide flexibility to the base portion, the first foldable portion including a protrusion sized to fit within the first aperture, and ensnare a portion of the first pocket between the aperture and the protrusion when the protrusion is inserted through the first aperture.

12. A method of packaging an article with the packaging kit of claim 2, the method comprising:

providing the packaging kit of claim 2;

inserting the first foldable portion into the first pocket;

folding the first foldable portion toward the base portion;

engaging the protrusion with the first aperture with a portion of the first pocket being disposed between the protrusion and the first aperture such that the portion of the first pocket is pushed through the first aperture by the protrusion; and supporting an article with the retention member, wherein the at least one cut line and the plurality of score lines provide flexibility to the base portion when supporting the article.

13. The kit according to claim 2, wherein the at least one cut line comprises two or more cut lines connected to each other.

14. The kit according to claim 2, wherein one of the plurality of score lines is connected to one end of the at least one cut line.

15. The kit according to claim 2, wherein each of the plurality of score lines comprises a curved portion.

16. The kit according to claim 2, wherein the base portion comprises an additional score line interconnecting two of the plurality of score lines.

17. The kit according to claim 16, wherein the additional score line is substantially parallel to the at least one cut line.

* * * * *